United States Patent [19]

Marcalus et al.

[11] 4,061,325

[45] Dec. 6, 1977

[54] METHODS AND APPARATUS FOR INTERFOLDING ENDLESS PAPER WEBS

[76] Inventors: Nicholas Marcalus; Jesse B. Smaw, both of One Market Street, East Paterson, N.J. 07407

[21] Appl. No.: 715,879

[22] Filed: Aug. 19, 1976

[51] Int. Cl.[2] ..... B41L 1/30

[52] U.S. Cl. ..... 270/40

[58] Field of Search ..... 270/39–41

[56] References Cited

U.S. PATENT DOCUMENTS

| | | | |
|---|---|---|---|
| 3,122,361 | 2/1964 | Moore | 270/40 |
| 3,472,504 | 10/1969 | Murphy | 270/40 |
| 3,845,948 | 11/1974 | Furbeck | 270/40 |

*Primary Examiner*—Edgar S. Burr
*Assistant Examiner*—A. Heinz
*Attorney, Agent, or Firm*—Burns, Doane, Swecker & Mathis

[57] ABSTRACT

A machine for interfolding webs of material which includes a plurality of interfolding mechanisms for interfolding webs into a plurality of elongate bundles. Drive mechanism is provided for advancing first and second ones of the bundles in taut condition, with the second bundle being disposed beneath the first bundle. First and second fold plates are disposed vertically intermediate the first and second bundles. These plates are inclined relative to a vertical plane and lie in generally mutually parallel planes. The first fold plate is arranged to guide the top web of the first bundle in an upwardly unfolded condition during advancement of the first bundle. The second fold plate is arranged to guide the bottom web of the second bundle in a downwardly unfolded condition during advancement of the second bundle. The first and second fold plates terminate prior to the point where the second bundle is deposited onto the first bundle, thereby allowing the tautly maintained, unfolded webs to assume an interfolded posture. The interfolding mechanisms each include a folding assembly which includes a stub element in the shape of a segmented curve. A rotatable roll is disposed intermediate a discharge edge of the stub element and a folding plate. A web slides over the stub element and is discharged from the discharge edge in a non-tangential direction onto the guide roller. The stub element is pivotably displaceable away from the guide roller to facilitate access to the mechanism.

4 Claims, 15 Drawing Figures

METHODS AND APPARATUS FOR INTERFOLDING ENDLESS PAPER WEBS

BACKGROUND AND OBJECTS OF THE INVENTION

This invention relates to improvements in interfolding machines in which webs of paper are interfolded into bundles which can be severed into appropriate lengths for facial tissues or other sanitary products.

Facial tissues are conventionally packaged in an interfolded relation, so that as one tissue is removed from its container, the succeeding tissue will be raised to an accessible position, and so on. Machines for interfolding webs of tissue are well known, as can be evidenced by Marcalus et al U.S. Pat. No. 3,850,425, dated Nov. 26, 1974. The Marcalus et al patent is particularly unique for its disclosure of a highly simplified and compact mechanism for interfolding webs of tissues, and this disclosure is incorporated by reference as if set forth at length herein. The present invention is an improvement thereon.

In accordance with principles disclosed in the Marcalus et al patent, roll-wound webs of tissue paper are arranged in a semi-circular array, with the webs converging to a central conveying mechanism. Folding assemblies are deploying to interfold adjacent webs as the webs are pulled by an approach the conveyor structure. Consequently, there is formed by the machine a bundle of interfolded webs of tissue paper. This web bundle is subsequently cut into stacks of appropriate lengths and a plurality of such stacks can be packaged in a typical slotted tissue container. As each tissue is withdrawn from the container, the succeeding tissue, due to its interfolded connection with the previous tissue, is lifted to an accessible position for subsequent withdrawal.

It is desirable that the tissues be packaged in quantities of about one hundred or more per container. An interfolding machine of the type employing principles described in the Marcalus et al patent would require enormous size and complexity in order to provide a bundle of such a large number of tissues. Such a machine would give rise to untold scores of problems concerning cost, space, maintenance, etc.

It has also been found that the rapid drawing of endless webs of paper across components of the folding assembly can produce friction and other binding which can lead to damage of the webs.

It is, therefore, an object of the present invention to provide a compact and convenient system for interfolding large numbers of paper webs.

It is another object of the present invention to provide methods and apparatus for interfolding the tissues of separate bundles of paper webs.

It is a further object of the present invention for providing methods and apparatus enabling a plurality of interfolding mechanisms to be employed in series whereby the output of all the mechanisms can be combined to form a stack of interfolded webs of paper that can be used for facial tissues and the like.

It is yet another object of the invention to provide a folding assembly for interfolding webs into a bundle which minimizes binding and yet which provides the required degree of tautness of the webs.

BRIEF SUMMARY OF THE INVENTION

These objects are achieved by the present invention which involves a machine for interfolding a plurality of endless bundles of interfolded paper webs. The machine includes mechanism for advancing first and second ones of the bundles in vertically spaced relation. The bundles are guided in progressively converging directions of travel. A bundle merging mechanism includes a pair of inclined plates arranged to hole a bottom web of an uppermost one of the bundles, and a top web of the lowermost one of the bundles, in unfolded position as the bundles are being converged. The plates terminate so as to allow the top and bottom webs to assume a mutully interfolded condition prior to final merging of the second bundle atop the first bundle.

Each interfolding mechanism includes a stub element which is in the shape of curved segment. The stub element terminates in a discharge edge which discharges its web in a non-tangential direction onto a guide roller. The guide roller is rotatably mounted to facilitate travel of the web to the folding plate. The stub element is pivotal so as to be displaceable away from the guide roller.

THE DRAWINGS

A preferred embodiment of the invention is illustrated in the accompanying drawings in which.

Figure 1:
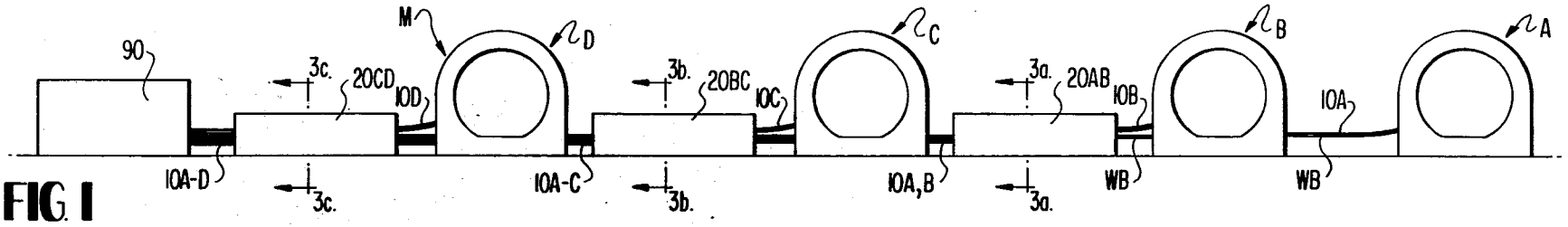
FIG. 1 is a schematic side elevational view of a bundle folding and merging machine according to the present invention.
Figure 3C:
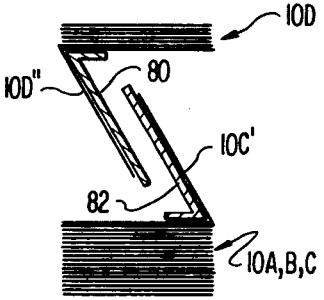
Figure 3B:
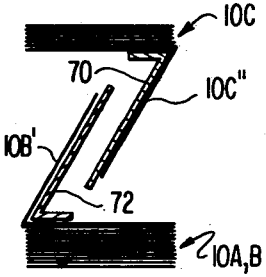
Figure 3A:
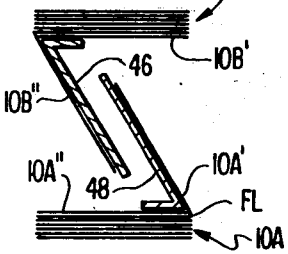
Figure 4:
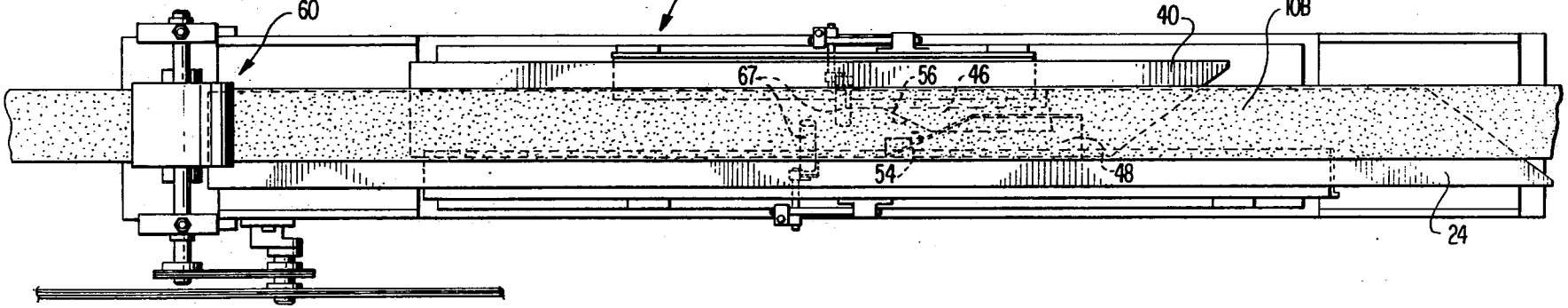
Figure 5A:
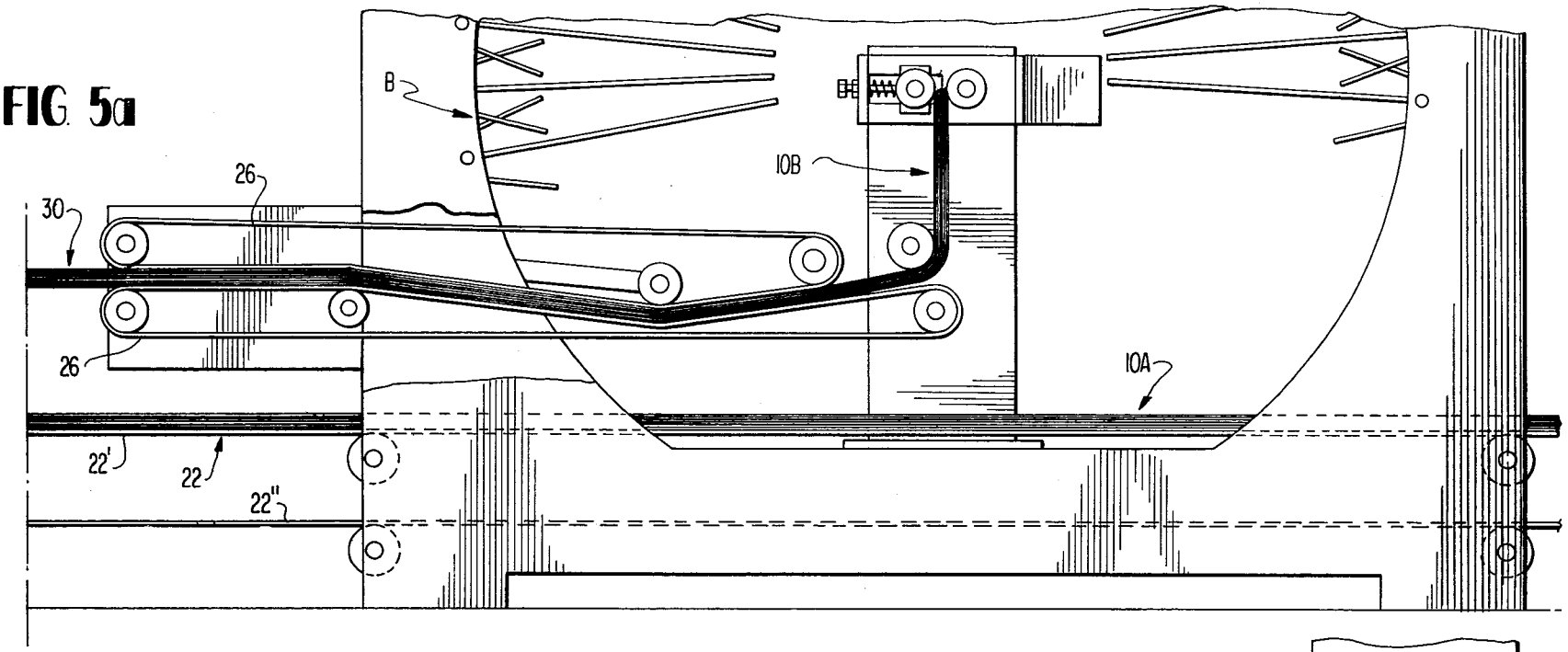
Figure 5B:
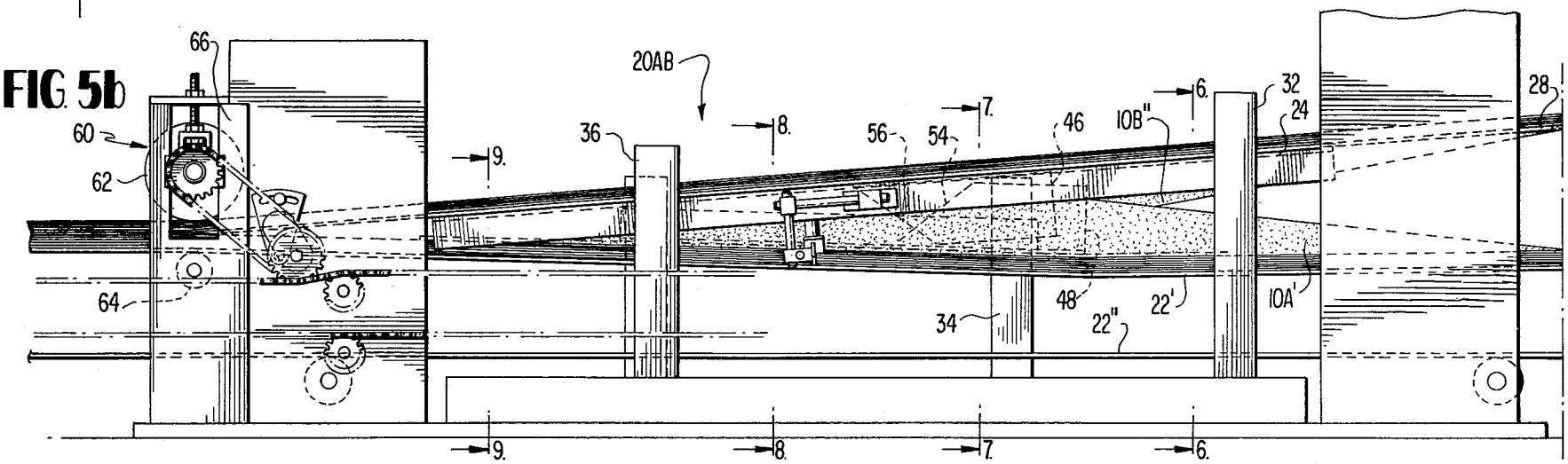
Figure 6:
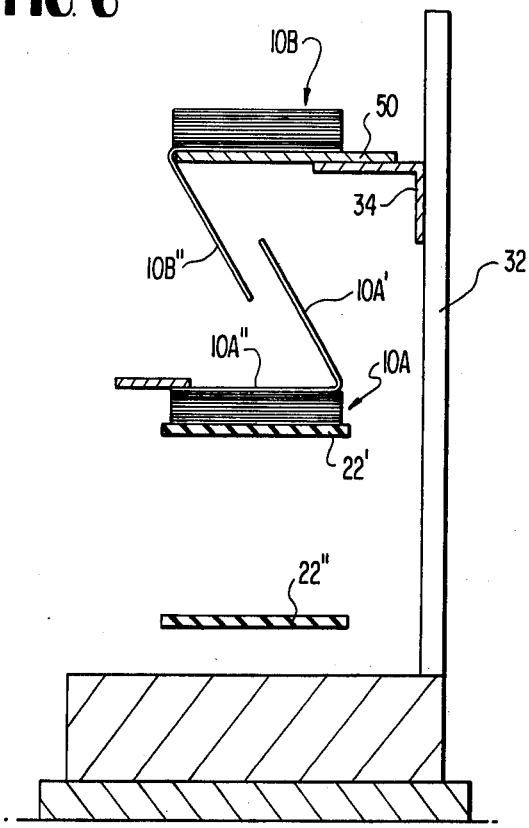
Figure 10:
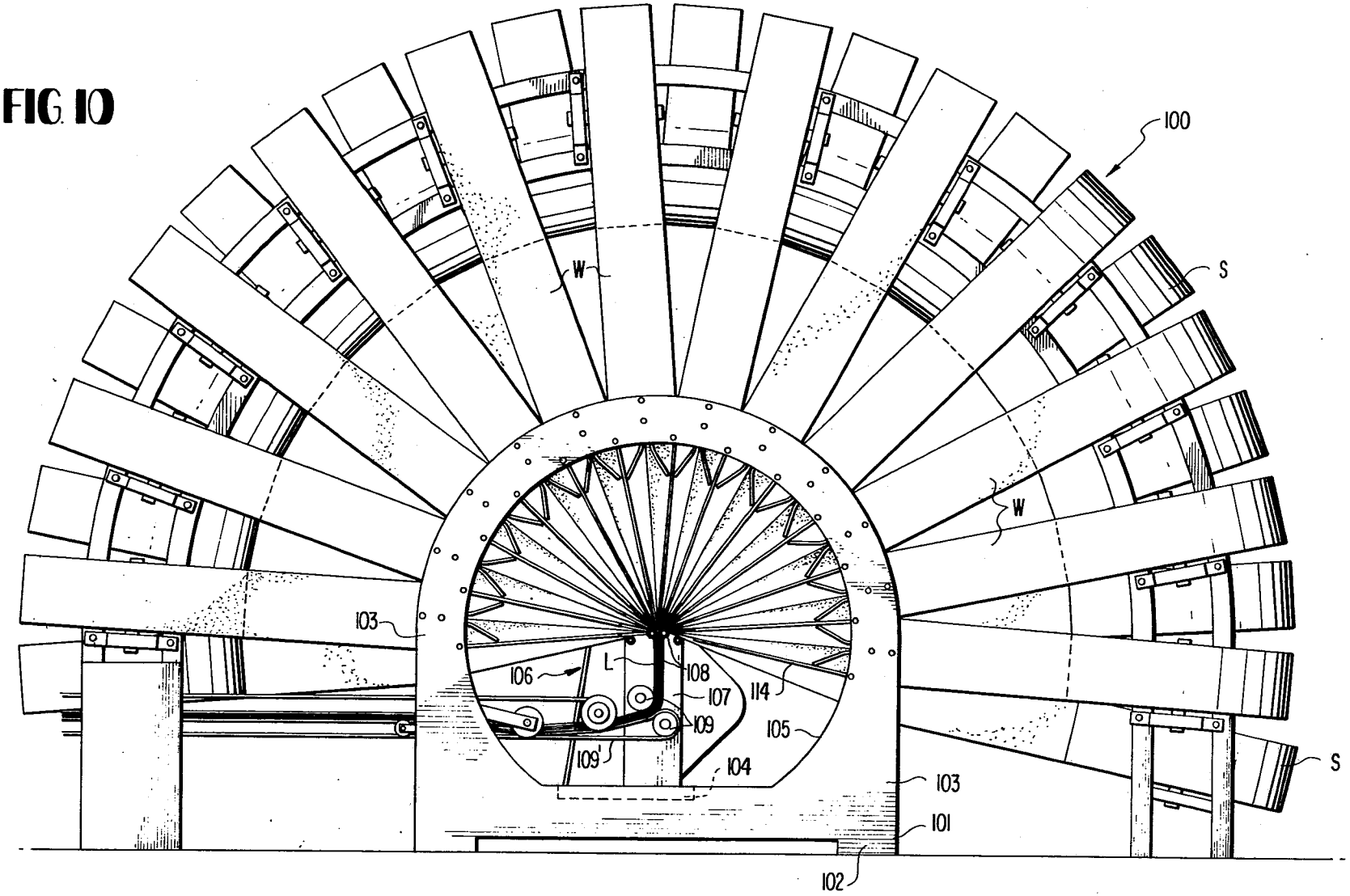
Figure 11:
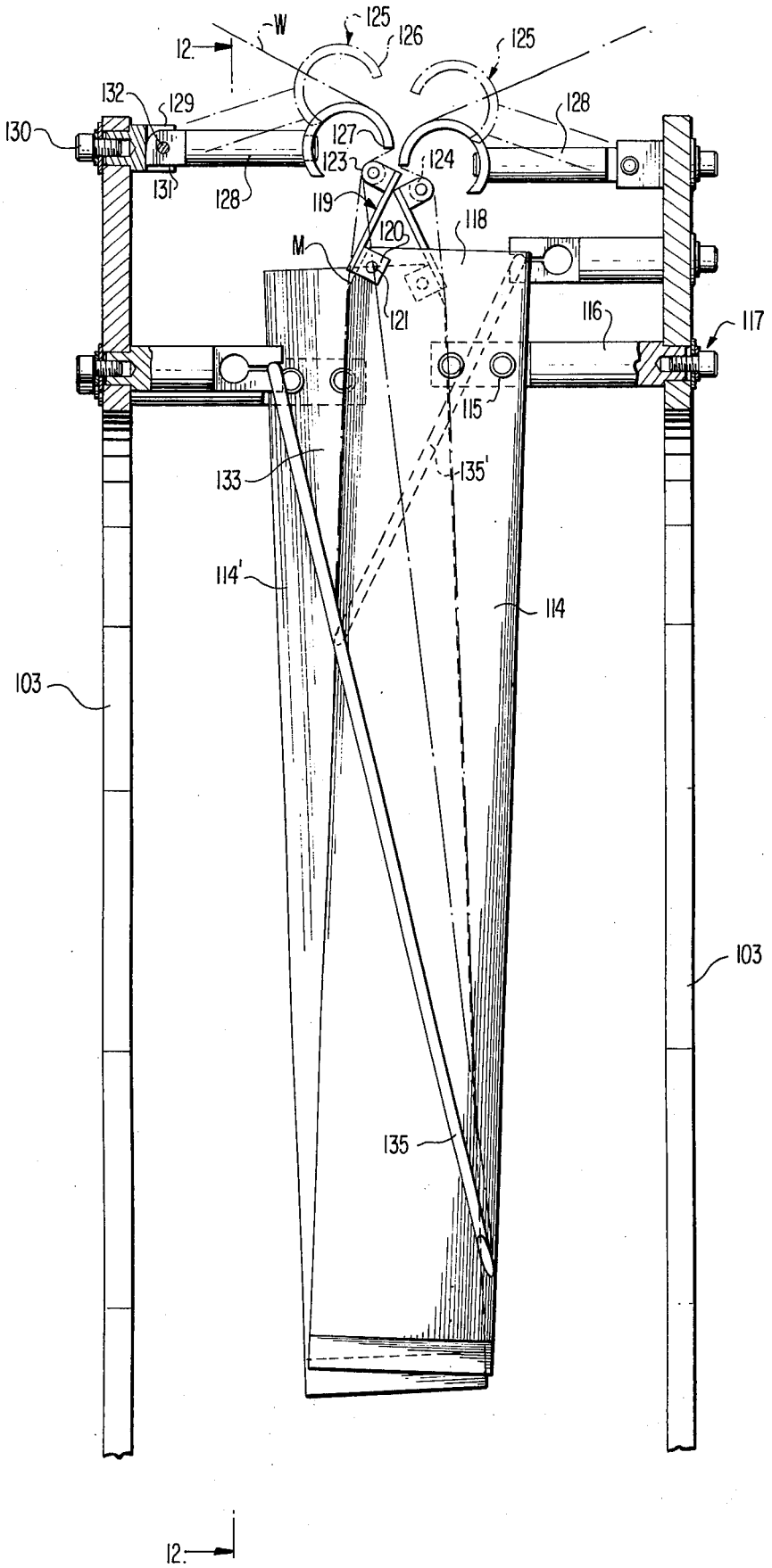
Figure 12:
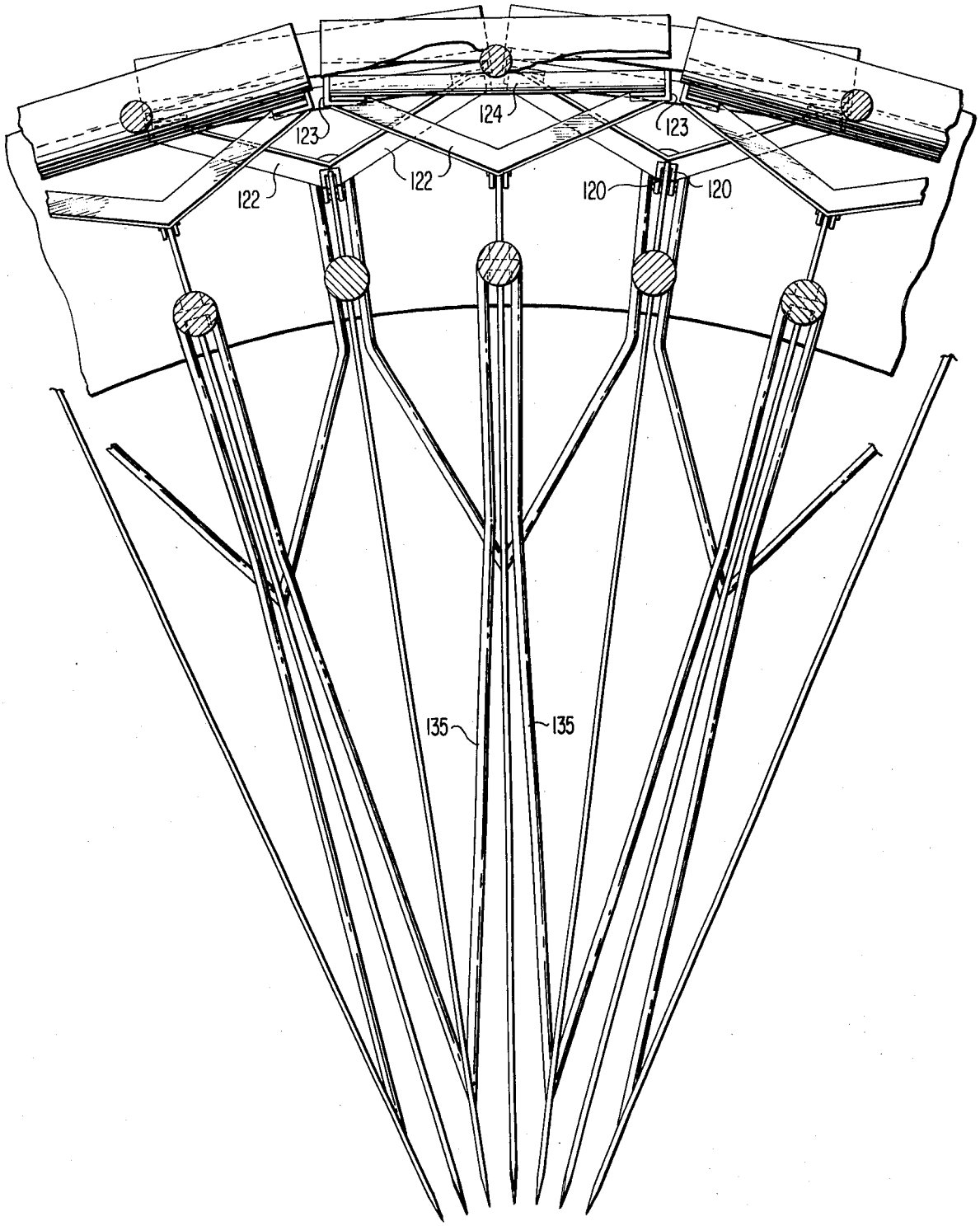

FIGS. 3*a* through 3*c* are cross-sectional views taken along lines 3*a*—3*a* through 3*c*—3*c* in FIG. 1;

FIG. 4 is a plan view of a bundle merging assembly in accordance with the present invention;

FIG. 5*a* is a side elevational view of a bundle forming machine;

FIG. 5*b* is a side elevational view depicting a bundle merging assembly located immediately downstream of the machine depicted in FIG. 5*a*;

FIGS. 6 through 9 are cross-sectional views taken along lines 6—6 through 9—9 of FIG. 5*b* depicting various parts of the bundle merging assembly;

FIG. 10 is a side elevational view of an interfolding mechanism in accordance with the present invention, with rolls of paper webs being installed thereon;

FIG. 11 is a side elevational view of an internal portion of the interfolding mechanism depicted in FIG. 10, to illustrate the folding assembly with parts broken away for clarity; and FIG. 12 is a cross-sectional view taken along line 12—12 of FIG. 11.

DETAILED DESCRIPTION OF THE PREFERRED EMBODIMENT

In a preferred embodiment of the present invention, a paper folding machine comprises a plurality of essentially identical interfolding stations A, B, C, and D which are arranged sequentially of one another (see FIG. 1). Each of the interfolding stations depicted in the drawings employs an interfolding mechanism operating in accordance with principles disclosed in connection with the aforementioned U.S. Pat. to Marcalus et al, No. 3,850,425. It will be appreciated from the following discussion that the present invention may also be operable in connection with other types and arrangements of interfolding machines which produce bundles of interfolded webs.

Figure 2:
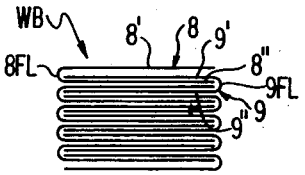
FIG. 2 is a schematic illustration depicting the condition of various webs within a bundle of the forming machine.

Suffice it to say at this point that at each bundling station a plurality of paper webs 8, 9, etc. are brought together and interfolded so as to form a bundle WB of interfolded webs which can be of the type shown schematically in FIG. 2. In that bundle arrangement, each web is folded approximately in half along a longitudinally extending fold line FL, with a top half 9' of one web 9 being interposed between the halves 8', 8'' of a second web 8 located thereabove in the bundle and itself similarly folded.

Thus, at the first interfolding station A, a bundle 10A is produced, while a bundle 10B is produced at the second station B, and so forth (see FIGS. 3*a*–3*c*).

In accordance with the present invention a series of bundle merging stations 20 AB, 20 BC, 20CD are situated downstream of the second, third and fourth interfolding stations B, C, D.

The interfolding stations A-D are positioned along a main conveyor in the form of an endless belt 22 (see FIG. 5). The belt 22 is wrapped around pulleys (not shown) spaced at the longitudinal ends of the system, with one of the pulleys being driven to drive the belt 22. The upper flight 22' of the belt 22 receives the interfolded web bundles 10A–D emitted from the various interfolding stations A–D. In this connection, the bundle 10A produced at the first interfolding station A is discharged directly onto the upper flight 22' of the main conveyor 22 and is advanced thereby toward the second interfolding station B of the series.

The bundle 10B produced at the second interfolding station B is discharged directly onto the top of the first bundle. As will be subsequently explained, this occurs as the bundles are being subjected to the action of the first merging station 20AB located between the first and second interfolding stations A, B. This merging station 20AB comprises a ramp 24 (FIG. 5*b*) whose top surface receives the second bundle 10B emitted from the second interfolding station B (FIG.5*a*). The second bundle 10B may, for example, be discharged from the second interfolding station B by being sandwiched between a pair of driven discharge conveyors 26 (FIG. 5*a*). The upstream end 28 of the ramp 24 is spaced from the discharge conveyors 26 to establish a gap 30 exposing the lowermost web half 10B'' of the bundle 10B. The ramp 24 is stationary and is affixed to any suitable support framework 32, 34, 36 situated along one side of the belt 22. The ramp 24 is forwardly and downwardly inclined so as to convergent with the belt 22.

Disposed beneath the ramp 24 is a horizontal divider wall 40 (FIG. 7) which is carried by suitable stationary framework 42, 44, located on a side of the belt 22 opposite the framework 32, 34, 36. This wall 40 is spaced above the upper flight 22' of the conveyor 22 by a distance generally corresponding to the thickness or height of the first bundle 10A.

Figure 7:
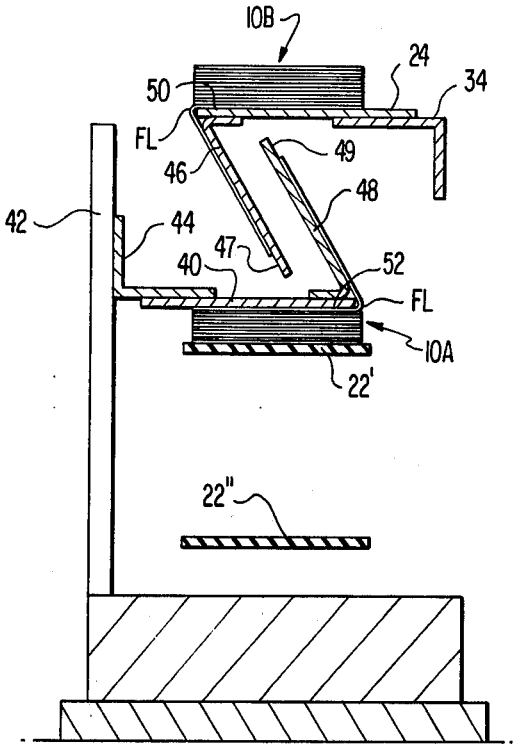
Figure 8:
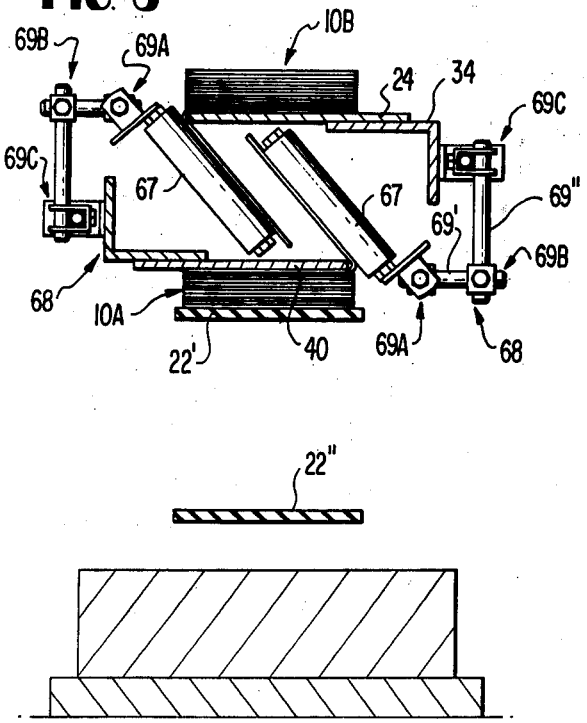

Suspended from the underside of the ramp 24 is a downwardly projecting, upper fold plate 46 (FIGS. 3*a* and 7). Projecting upwardly from the topside of the divider wall 40 is a lower fold plate 48. The upper fold plate 46 extends generally from a longitudianl edge 50 of the ramp, along which edge 50 the lowermost web fold FL of the second bundle 10B is disposed, as can be viewed in FIG. 7. The lower fold plate 48 extends generally from a longitudinal edge 52 of the wall 40, along which edge the uppermost web fold FL of the first bundle 10A is disposed. Thus, the edge 52 is diagonally opposite the edge 50. The fold plates 46, 48, lie in generally parallel planes and are inclined inwardly of the longitudinal edges 50, 52, of the ramp and divider wall.

The upper and lower fold plates 46, 48, have outer surfaces 47, 49, arranged to guide the merging webs of the first and second bundles 10A, B. Thus, the upper fold plate 46 is arranged to guide the bottom-most web half 10B'' of the second bundle 10B, while the lower fold plate 48 is arranged to guide the top-most web half 10A' of the first bundle 10A. In this fashion, as the first and second bundles 10A, B, travel in substantially superposed paths through the merging station 20AB, their mutually facing webs are supported by the plates in an unfolded condition.

Downstream or terminal edges of the fold plates 46, 48 are configured to facilitate an interfolding of these unfolded webs. In this connection, a terminal edge 54 of the lower fold plate 48 is inclined downwardly in the direction of bundle travel, and a terminal edge 56 of the upper fold plate is inclined upwardly in the direction of bundle travel (FIG. 5*b*). In this manner, the merging web halves 10A', 10B'', are allowed to progressively assume a horizontal position upon leaving the fold plates 46, 48, thereby providing for a smooth, interferencefree merging.

A synchronous rate of travel of the first and second bundles 10A, 10B is provided by a bundle advancing mechanism 60 disposed at the downstream end of the first merging station 20AB. This advancing mechanism 60 includes a drive roller 62 and a backing roll 64 positioned below the belt 22. The drive roll 62, and backing roll 64 define a nip zone therebetween. The drive roller is vertically adjustably mounted on a framework 66 to provide varying degrees of frictional engagement with the double bundle group 10A, B, defined by the first and second bundles 10A and 10B as they assume a fully merged or united condition. This tends to prevent bunching of the bundles as they are merged. Also, the compression of the double bundle group 10A, B, within the nip zone serves to compress the double bundle to a suitable thickness for passing through the subsequent merging station 20BC.

Importantly, the advancing mechanism 60 serves to produce sufficient tension in the bundles to maintain the webs in a taut condition, thereby facilitating the interfolding action occurring after the merging web halves leave the folding plates 46, 48.

Control over the merging web halves within each merging station is augmented by the deployment of a plurality of guide rollers 67 (FIG. 8) on both sides of the ramp 24 and divider wall 40 in the vicinity of the terminal ends 54, 56, of the upper and lower fold plates 46, 48. The rollers 67 are each mounted on a mounting assembly 68 that includes three clamps 69A, 69B, 69C. The clamp 69A provides adjustment of the inclination of the rollers 67 in a vertical plane. The clamp 69B adjustably receives an arm 69' of the clamp 69A and provides for horizontal shifting of the roller toward and away from the ramp 50 and divider wall 40. The clamp 69C is mounted to the stationary frame 34. An arm 69'' of the clamp 69B is adjustably received in the clamp 69C. This enables the roller to be adjusted vertically, and to swing about a vertical axis. Preferably, the rollers 67 are adjusted so that their axes lie essentially parallel to the planes of the fold plates 46, 48. These rollers guide and urge together the web halves 10A', 10B'', after leaving the fold plates 46, 48.

Subsequent to merging of the first and second bundles 10A, 10B into a double bundle group 10A–B the double bundle group 10A–B is conveyed to a secong merging station 20 BC to be merged with a third bundle 10C produced by the third interfolding station C. The second merging station 20BC is similar to the first merging station 20AB.

However, when merging bundles of odd-numbered webs, as opposed to even-numbered webs, it is necessary to reverse the orientation of the fold plates 70, 72, at the second merging station due to the fact that the fold lines of the merging web halves will be positioned at opposite sides of the conveyor 22 relative to their positioning at the first merging station. Such relative orientation of the fold plates is depicted in FIGS. 3*a* 3*b* and 3*c*, wherein plates 70, 72, at the second merging station 20BC are reversed relative to the plates 46, 48, at the first merging station 20AB, and wherein the plates 80, 82 at the third merging station 20CD are reversed relative to the plates 70, 72, at the second merging station 20BC.

Another distinction between the first and second merging stations involves the height of the divider wall above the upper flight 22' of the conveyor belt 22. For example, since the belt 22 carries a double bundle group 10A–B to the second merging station 20BC, a higher passage must be provided between the divider wall and the belt 22 at that section, and so forth.

It will be appreciated that any desired number of interfolding stations and merging stations may be provided to form a bundle group of any desired thickness.

Downstream of the last interfolding machine D a bundle severing machine 90, of conventional construction, is disposed for severing the bundle group 10A–D into sections suitable for packaging in a conventional tissue dispenser.

An improved mechanism 100 for interfolding the webs at each interfolding station includes a stand, generally indicated by the numeral 101, having a base 102 for secure mounting upon the floor or support for the mechanism (FIG. 10). The stand 101 includes upright side plates 103 spaced apart transversely and having a platform 104 secured therebetween. The stand 101 is provided with a central opening 105 in one or both of the side plates 103 for visual inspection of the interfolding of the sheets and to facilitate the feeding of the sheets through the mechanism.

Mounted upon the platform 104 is a pull stand, generally indicated at 106, which is located centrally of the opning 105. The pull stand 106 comprises a frame assembly 107 which is secured upon the platform 104 and extends upwardly therefrom. A pair of top pull rolls 108 is mounted in the upper end of frame 107, having the bite between the rolls in an upright direction so as to receive therein the long bundle of webs and to direct the bundle downwardly, as indicated in dotted lines in FIG. 10.

A second pair of pull rolls is indicated at 109, also mounted in the frame 107, with the bite therebetween in a horizontal direction. A conveyor 109' has one end thereof wrapped around one of the rollers 109. Thus, the long bundle of interwoven webs, indicated at L in FIG. 10, extends downwardly from the bite of the rolls 108 and horizontally between the rolls 109 and conveyor 109', to be directed out of the mechanism.

The rolls 108 and 109 are driven by any suitable drive means, such as an endless sprocket chain (not shown) operatively connected with the shafts of the rolls 108 and 109. Any suitable or desired motive power may be connected thereto, such as an electric motor, for example.

The paper webs are illustrated in FIG. 10 at W, each being drawn from a spool of paper S of desired character to form the facial tissues in this instance, or other types of interwoven papers when the interfolding is completed, and these are severed to the desired lengths. The webs W are fed into the mechanism 100 in staggered relation, with one web overlapping the adjacent edges of two webs offset therefrom, as indicated generally in FIG. 100.

The interfolding assembly comprises an arrangement of folding plates, generally indicated at 114 (FIGS. 10–12), each of which is in the form of a flat plate extending generally radially outward from a point spaced from the bite of the pull rolls 108, as will be apparent from FIG. 10. Each of the folding plates 114 is securely mounted at 115 on a plate support 116 extending laterally therefrom to the adjacent side plate 103 (FIG. 11). The plate support 116 is in the form of a rod in this embodiment of the invention, with the plate 114 fixed to one end thereof and the opposite end being adjustably mounted in the side plate 103 by the adjusting means generally indicated at 117. A threaded end of the rod 116 receives nuts for clamping the end portion in an adjusted position with respect to the side plate 103. The mechanism 100, as thus far described, is essentially conventional and is explained in U.S. Marcalus et al U.S. Pat. No. 3,850,425.

Each of the folding plates 114 has an upper end portion 118, the outer end of which is inclined at M and has mounted thereon a guide member 119. In this embodiment of the invention, each guide member 19 is V-shaped, as illustrated in FIG. 12, and is shaped from a flat plate. At the apex end thereof a pair of flanges 120 are mounted. These flanges are spaced to form a slot in which is received the inclined portion M of the plate 114. A pin 121 extends through the flanges 120 and the plate 114 to secure the guide member to the plate. The guide member includes a pair of legs 122 which, at their outer ends carry ears 123. The ears 123 form bearings which rotatably receive a guide roller 124. Thus, the guide roller is rotatably mounted at the expanded end of the V-shaped guide member 119 and is located outwardly of the associated plate 114 and slightly toward the side plate 103 to which such plate 114 is connected.

A snub element 125 is mounted outwardly of the guide roller 124. Thus, the guide roller lies intermediate the snub element 125 and the plate 114. The snub element 125 is in the form of a segment of a curve. Therefore, the snub element includes an outer periphery 126 of a curved segmented shape, which periphery terminates in a discharge edge 127. A rod 128 carries at one end, the snub element 125 and, at the other end, is pivotally mounted to the side plate 103 opposite the side plate 103 to which the associated plate 114 is connected. The mounting of the arm 128 takes the form of a coupling 129 which is adjustably attached to the side plate 103 by a threaded screw 130. The coupling 129 forms a slot which receives a tongue 131 of the arm 128. A pin 132 passes through the coupling and the tongue 131 to provide for pivotal movement of the arm. Thus, the stub element 12 may be displaced outwardly away from the plate 114 and the guide roller 124 to facilitate access to the interfolding assembly, as depicted in phantom lines in FIG. 11.

The manner in which the web W traverses the interfolding assembly is depicted in phantom lines in FIG. 11. It can be seen that the web W passes around a portion of the periphery 126 of the stub element 125 and is discharged from the discharge edge 127 in a direction which is non-tangential relative to the curvature of the stub element. The web W then passes over the guide roller 124 and around the edge 133 of the plate 114.

A pair of folding fingers 135 (only one being shown in FIG. 11) straddle the plate 114. These fingers extend downwardly in diverging relation. The web W passes between these fingers and the plate 114, thereby causing the web to be folded about the edge 133. In this manner a longitudinal portion of one web is urged toward an eventually into engagement with a longitudinal portion of an adjacent web, to establish the interfolded condition of the webs.

The fingers 135' of an adjacent plate 114' can be shorter in extent than the fingers 135 which accomplish a similar result.

It is noted that the provision of rotatable guide rolls 124 facilitate travel of the web and minimizes binding which otherwise might result in tearing of the web.

The segmental configuration of the stub element 125 wherein the web is discharged in a non-tangential direction aids in maintaining the prescribed degree of tautness of the web during its travel.

Access to the various components of the folding assembly is facilitated by the pivoted mounting of the stub element.

OPERATION

Each web W is fed into the mechanism 100 over one of the snub elements 125. As will be apparent in FIG. 12, each of the snub elements 125 has one of the folding plates 114 midway of the length thereof and also midway of one of the V-shaped guide members 119. This staggered relation of the webs and of the snub elements 125 will cause each web to be so located that the folding edge thereof will lie midway between opposite edges of the web.

The folding edge of each plate 114 is the edge thereof over which the paper web is folded, as indicated at 133 in FIG. 11. The mounting of the folding plates 114 is such that the upper end portions thereof are substantially side-by-side so as to be tangent to planes spaced apart axially of the machine but extending normal to the axis.

The folding plates 114 are so mounted, however, that the lower end portions of next successive plates diverse somewhat, as indicated in FIG. 11.

The paper webs W enter the machine in substantially flat staggered relation, as indicated in FIG. 10. Each web slidingly passes across the periphery 126 of its associated snub element 125 and is discharged therefrom non-tangentially onto the guide roller 124. From there, the folding action is started as the web passes over the guide member 119, as shown in FIG. 11. This action is continued as the web W is drawn downward through the mechanism lengthwise of the fold plates 114. It will be apparent that the lateral edges of one web overlap the adjacent edges of the next two adjacent webs as these respectively are folded around the fold edges 133 of alternate folding plates. The downward converging relation of these plates, as well as further diverging in the direction of their width, will cause these edge portions of the webs to be brought closer and closer together, until they are nearly in flat relation when they pass over the inner ends of the folding plates and travel toward the bite of the pull rolls 108. The folded webs are thus brought together in a bundle in the bite of the pull rolls 108, this bundle being indicated at L in FIG. 10, and then traveling horizontally from the machine.

The folding fingers 135 that straddle the fold edge of the folding plate 114 causes the web to be turned over the fold edge 133 thereof and downward in interfolded relation with adjacent webs. These fingers 135 preferably extend diagonally of the width of the respective folding plates 114 and at substantial angles, such as right angles, to the plane of the V-guides 119. Thus, the initial shaping of the folds by the V-guides 119 will be further extended as the webs travel under the folding fingers 135.

The inner ends of the folding plates 114 are spaced from the bite of the pull rolls 108 a distance sufficient for access to the interfolded webs through an opening 105. This may be needed in the event that one or more of the webs should be broken, causing a jamming of the paper in the machine.

The degree of overlap of the webs may be varied by adjusting the angular positions of the alternate folding plates 114. This will vary the degree of divergence of the alternate plates transversely of each other and thus contract or spread apart the degree of overlapping of the edge portions of the webs.

A first bundle 10A of interfolded webs is produced at the first interfolding station A and is discharged onto the upper flight 22' of the main conveyor belt 22. The bundle 10A is advanced to the first merging station 20AB whereupon an operator manually contacts and lifts the uppermost web half 10A' so that the latter assumes a position along the outer surface 49 of the lower fold plate 48. Also, a second bundle 10B produced at the second interfolding station B is discharged onto the ramp 24, whereupon the operator manually contacts and lowers the lowermost web half 10B' of the second bundle 10B so that the latter travels along the outer surface 47 of the upper fold plate 46. Once such a condition of the web halves 10', 10B'' is established, no further action of the operator is required since these web halves will continually travel along the plates 46, 48, as the bundles advance.

Figure 9:
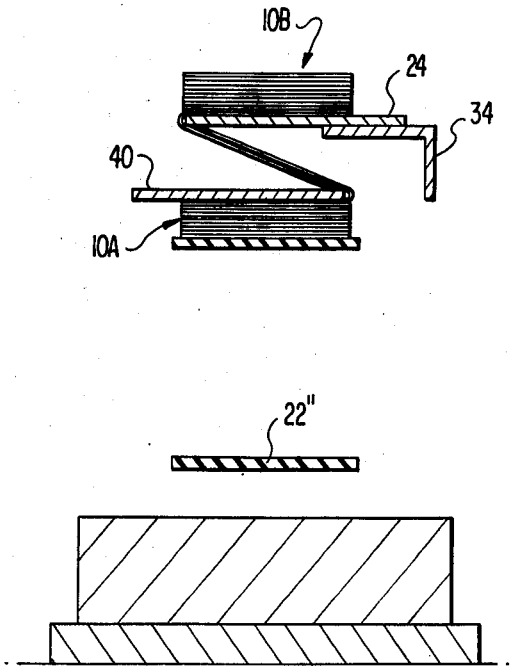

At the tautly-tensioned web halves 10A', 10B'', leave the terminal edges 54, 56, of the fold plates 46, 48, they gradually assume an inclined, mutually contacting relationship (FIG. 9). Eventually these halves assume horizontal, interfolded postures at the point where the second bundle 10B is deposited onto the first bundle 10A.

Subsequent to this merging action, the double bundle group 10A–B travels to the second merging station 20BC whereupon it is merged with the third bundle 10C produced at the third interfolding station C, and so on, until a bundle group of desired size has been produced for severing.

Although the invention has been described in connection with a preferred embodiment thereof, it will be appreciated by those skilled in the art that additions, modifications, substitutions and deletions not specifically described may be made without departing from the spirit and scope of the invention as defined in the appended claims.

What is claimed is:

1. A machine for interfolding first and second bundles of interfolded paperous webs comprising:

a conveyor for advancing said first bundle forwardly;

means for advancing said second bundle forwardly in overlying relation relative to said first bundle;

a ramp for supporting said second bundle, said ramp being spaced above and converging forwardly downwardly toward said first bundle in superimposed relation therewith;

a first fold plate inclined upwardly and laterally inwardly relative to web movement from an edge of said first bundle where a fold line of the top web is located;

a second fold plate spaced from said first fold plate and inclined downwardly and laterally inwardly from an edge of said second bundle, diagonally opposite said first-mentioned edge, where a fold line of the bottom web is disposed;

said first and second fold plates arranged to guide the top web portion of said first bundle and the bottom web portion of said second bundle, respectively, in an unfolded condition as said first and second bundles converge vertically toward one another;

a terminal edge of said first fold plate being inclined downwardly in the direction of bundle travel and the terminal edge of said second fold plate being inclined inwardly in the direction of bundle travel;

said first and second fold plates terminating short of the point of final merging of said bundles, allowing said unfolded webs to assume a mutually interfolded posture.

2. In a machine for interfolding webs of paper comprising:

a plurality of generally radially arranged elongated fold plates converging longitudinally from outer ends thereof toward inner ends thereof, each plate including a web folding edge, the folding edge of each plate being situated at a side thereof opposite the folding edge of an adjacent plate, a snub element spaced from the outer end of each folding edge, said snub element having a curved periphery defining a web discharge edge, said discharge edge being offset from the line of its associated folding edge in a direction toward a side of the plate opposite said folding edge so that an imaginary line between the outer ends of said folding edge and said discharge edge extends at an angle relative to said folding edge;

means for feeding a web of paper across the curved periphery of said snub element and along the folding edge of each plate so that said web is folded longitudinally in half along said folding edge, means for overlapping one half of one web with one half of an adjacent web so that as said webs gradually converge along said converging plates, said adjacent webs become interfolded, and a rotatably mounted guide roller spaced from the outer end of each folding edge, said roller being freely rotatable about an axis extending substantially perpendicular to the plane of the associated plate, said roller including a web-contacting periphery which is offset from said imaginary line so that the web is deflected from such imaginary line to a position nontangential relative to the curved periphery of said snub element to increase the tautness of the web.

3. A machine according to claim 2 wherein said snub element is mounted at the end of an arm; an inner end of said arm being pivotably mounted so that said snub element can be pivoted away from its associated plate to facilitate access thereto.

4. A machine according to claim 2 including a V-shaped support having an apex secured to its respective folding plate and an expanded end carrying bearings which rotatably support the associated guide roller.

* * * * *